US006630653B2

(12) United States Patent
Gerdes et al.

(10) Patent No.: US 6,630,653 B2
(45) Date of Patent: Oct. 7, 2003

(54) DEVICE FOR ADJUSTING THE DISTRIBUTION OF MICROWAVE ENERGY DENSITY IN AN APPLICATOR AND USE OF THIS DEVICE

(75) Inventors: Thorsten Gerdes, Bayreuth (DE); Monika Willert-Porada, Bayreuth (DE); Klaus Rödiger, Bochum (DE)

(73) Assignee: Widia GmbH, Essen (DE)

( * ) Notice: Subject to any disclaimer, the term of this patent is extended or adjusted under 35 U.S.C. 154(b) by 0 days.

(21) Appl. No.: 10/168,786

(22) PCT Filed: Jan. 19, 2001

(86) PCT No.: PCT/DE01/00259

§ 371 (c)(1),
(2), (4) Date: Jun. 18, 2002

(87) PCT Pub. No.: WO01/58215

PCT Pub. Date: Aug. 9, 2001

(65) Prior Publication Data

US 2002/0190061 A1 Dec. 19, 2002

(30) Foreign Application Priority Data

Feb. 4, 2000 (DE) ..... 100 05 146

(51) Int. Cl.[7] ..... H05B 6/70

(52) U.S. Cl. ..... 219/695; 219/696; 219/746; 219/750

(58) Field of Search ..... 219/679, 690, 219/691, 695, 696, 697, 700, 745, 746, 748, 750, 762

(56) References Cited

U.S. PATENT DOCUMENTS

| | | | |
|---|---|---|---|
| 3,993,886 | A | 11/1976 | Imberg et al. |
| 4,689,459 | A | 8/1987 | Gerling |
| 4,851,630 | A | 7/1989 | Smith |
| 5,512,736 | A | 4/1996 | Kang et al. |

FOREIGN PATENT DOCUMENTS

| | | |
|---|---|---|
| DE | 1 615 463 | 8/1973 |
| DE | 26 22 173 | 12/1976 |
| DE | 28 49 777 | 9/1979 |
| DE | 36 41 063 | 6/1988 |
| DE | 38 11 063 | 10/1989 |
| DE | 42 35 410 | 4/1994 |
| WO | WO 96/33830 | 10/1996 |
| WO | WO 97/26383 | 7/1997 |

*Primary Examiner*—Philip H. Leung
(74) *Attorney, Agent, or Firm*—Herbert Dubno

(57) ABSTRACT

The invention relates to a device for adjusting the distribution of microwave energy density in an applicator which forms a resonator chamber and in which the radiation generated by microwave generators is guided to the applicator wall by waveguides; and to a use for this device. According to the invention, several electroconductive coupling pins (31) are used, each of these extending preferably vertically into both the waveguide chamber and the applicator resonator chamber, in order to feed in the microwaves with as little loss as possible and to enable the field distribution in the resonator chamber to be modified. The invention is especially suitable for producing a plasma.

17 Claims, 3 Drawing Sheets

DEVICE FOR ADJUSTING THE DISTRIBUTION OF MICROWAVE ENERGY DENSITY IN AN APPLICATOR AND USE OF THIS DEVICE

CROSS REFERENCE TO RELATED APPLICATIONS

This application is a national stage of PCT/DE01/00259 filed Jan. 19, 2001 and based upon German national application 10005146.4 filed Feb. 4, 2000 under the International Convention.

1. Field of the Invention

The invention relates to a device for adjustment of a microwave energy density distribution in an applicator formed by a resonator chamber and in which the radiation generated by a microwave generator is fed to the applicator wall via waveguides and to the use of this device.

2. Background of the Invention

In a typical industrial construction in which microwaves are used, the microwave generator, which can be, for example, a magnetron, together with its current supply, are separate from the applicator in which the microwave energy is effective. For this purpose, waveguides and optionally other components, are used to feed the microwave energy into the application resonator chamber.

So as to be able to generate a multiplicity of modes with different phase orientations in an application, whereby a homogeneous field distribution can be achieved, the applicator has mainly dimensions which are a multiple of the wavelength of the supplied microwaves. For this purpose, the waveguides can be flanged on one side of a square-shaped applicator. This has, however, the disadvantage that, depending upon the spatial extent of the sampling groups found in the applicator, based upon the field distribution, a sufficiently homogeneous field distribution can be achieved only at certain regions. It is helpful to provide slotted graphite plates through which the microwaves are fed into the interior of the furnace from a waveguide. The waveguides then are located at the corners of the applicator chamber and the slits are arranged at different angles.

With highly absorbent materials in the resonator chamber, the result is significant changes in the microwave distribution with greater loading of the chamber with articles to be heated. Because of the fixed aforedescribed arrangement of the slit-shaped antennae, it is also not possible to vary the field distribution in the resonator interior within the desired limits.

OBJECT OF THE INVENTION

It is thus the object of the present invention to provide a device of the type described at the outset in which the microwave feed is effected with the least supply losses and so that a variation in the field distribution in the resonator chamber is possible.

SUMMARY OF THE INVENTION

This object is achieved with a device according to the invention, is wherein a plurality of electrically effective coupling pins are provided which project respectively both into the waveguide compartment and also into the applicator compartment preferably perpendicularly. Such pin-shaped antennae permit a greater field homogeneity to be generated in the resonator chamber, which however is separated from the waveguide, so that gasses which arise in the resonator chamber cannot penetrate into the waveguide. This is especially advantageous in the heat treatment of prepressed green bodies as are produced by powder metallurgical techniques and which are subjected to a dewaxing (binder removal). This applies for sintering processes which are to be carried out in a carburizing atmosphere.

The coupling pins are arranged to be shiftable along their longitudinal axes so that the desired field distribution in the applicator charge with the articles to be heated is adjustable. Optionally, with a corresponding coupling pin arrangement, graduated fields are obtainable, for example, a field which increases in the chamber which advantageously can be necessary for a so-called continuous traveling principle, i.e. with a translational movement of the articles to be treated through the resonator chamber. Field dependence can be provided both by choice of the lengths of the coupling pins and here especially by the respective proportions of the lengths of the coupling pins which project into the waveguide and into the resonator chamber. The coupling pin can extend into the waveguide both from its broad side as well as from its small side.

Preferably the waveguide and the surface at which the energy is coupled into the resonator chamber have their longitudinal axes arranged parallel to one another so that a multiplicity of coupling pins spaced apart equidistantly from one another can have their one ends project into the waveguide and their other ends project into the resonator chamber. A dielectric is disposed around the wall passages through which the coupling pins pass. For these purposes various embodiments can suffice. Thus in a first variant, the coupling pins can be shiftably guided in sleeves of dielectric material and extending through the wall of the waveguides and/or of the applicator. In a second variant, the electrically conducted coupling pins are formed from a coupling rod and a sleeve surrounding this rod and in which the coupling rod is shiftable along its longitudinal axis. Finally the coupling pin can have on its end projecting into the waveguide, a piece which elongates this pin and is composed of a dielectric which preferably passes through the waveguide along a diameter thereof and extends outwardly at its opposite end through an opening in the waveguide.

Materials for the coupling pin can include graphite, metals like for example copper, aluminum, tungsten or molybdenum, metal alloys like brass, steel or other alloys which however must be correspondingly temperature-resistant, or insulators with an electrical coating which preferably are comprised of TiN. As materials for the dielectric, boronnitride or a ceramic like aluminum oxide, silicon nitride or quartz is selected.

As seen in the longitudinal axial direction of the waveguide, the coupling pins respectively project in the regions of the maxima of the their supplied microwave. The coupling of the microwaves into the system can be effected capacitively or inductively.

The geometry of the pins, is according to a further feature of the invention, cylindrical whereby preferably the edges and corners of the pins are rounded. In a practical application, the diameter of the coupling pin can range between 1 mm to 30 mm, preferably 5 mm to 15 mm; the pin length 1, by which the coupling pin projects into the resonator chamber amounts to $1=x\cdot\lambda$ (where $0\leqq x\leqq 1$ and $\lambda$ is the wavelength of the microwave in the waveguide. Preferably $1=\lambda/4$ to $\lambda/2$.

The ratio of the opening diameter D in the waveguide, through which the coupling pin is passed to the coupling pin diameter d is so dimensioned that it matches the wave resistance. The spacing of the coupling pins amounts to $1=\lambda/4$ to $\lambda/2$ where $\lambda$=the wavelength of the microwave in the waveguide.

The articles treated by the microwave are arranged on lattice grates in the applicator resonance chamber, the grates being composed of rounded grate rods which preferably are oriented perpendicular to the electrical fields of the microwaves.

According to a further feature of the invention, the walls of the waveguide and the applicator which lie next to one another or against one another are thermally insulated from one another.

The described device can be used for removing binder from green bodies composed of a binder and one of the materials named below and/or for the sintering of such materials which can include hard metals is cermets, powder metallurgically produced, steels or metallic or ceramic magnetic materials, especially ferrites. Special examples of applications of the choices of the composite materials are produced in a microwave field by sintering and the process condition can be found in WO 96/33830 and WO 97/26383.

The described apparatus can also be used for producing a plasma as may be necessary for example in CVD coating.

BRIEF DESCRIPTION OF THE DRAWING

Examples of the invention are illustrated in the drawing.

SPECIFIC DESCRIPTION

Figure 1:
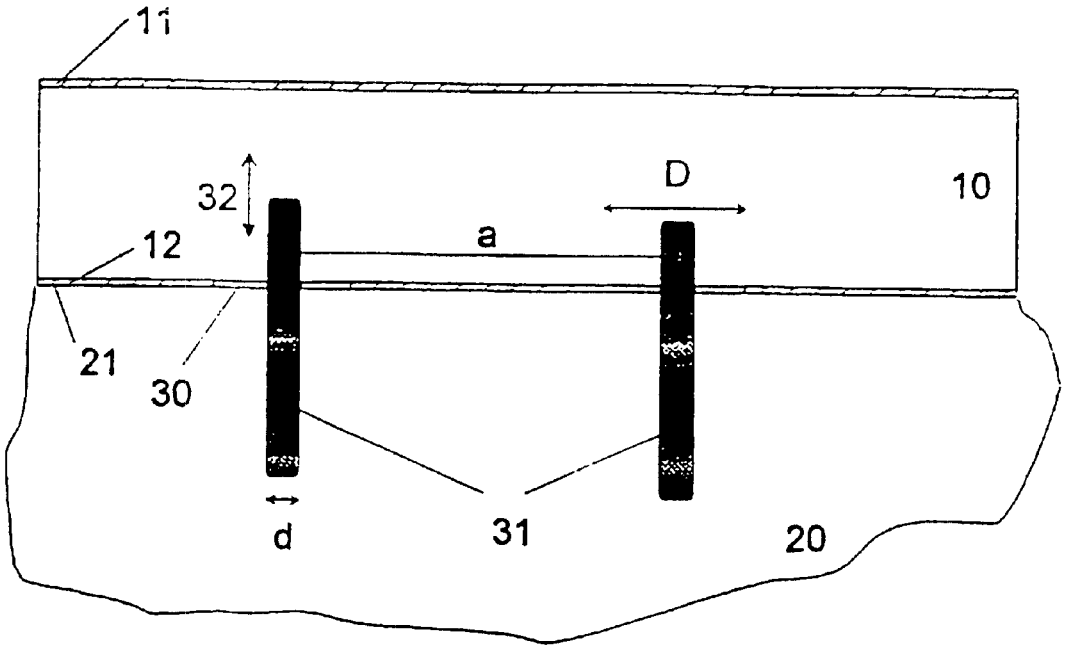
FIGS. 1 to 4 are diagrams of various arrangements of coupling pins and dielectric each in a schematic manner.

FIGS. 1 to 4 show a waveguide 10 with an upper wall 11 and a lower wall 12 in cross section. Against wall 12 of the waveguide 10 lies the wall 21 of the applicator resonance chamber whose illustrated segment has been designated at 20. The two walls 12 and 21 are each interrupted at equidistant spacings (a) by passages, the distance (a) corresponding to about half to a quarter of the wavelength of the microwave in the waveguide 10. In practice only one of the variants with respectively arranged coupling pins is used. In a first variant (FIG. 1) the passages through the walls 12 and 21 are surrounded by a circular dielectric 30. The mean diameter D of the dielectric through which the electrically-conductive coupling pin 31 of graphite passes is so selected relative to the diameter d of the cylindrical coupling pin that the wave resistance is matched. The coupling pin 31 projects with its two ends one into the resonator chamber 20 of the applicator and the other into the interior of the waveguide 10. The coupling pin is shiftable longitudinally axially in the direction of the double-headed arrow 32.

Figure 2:
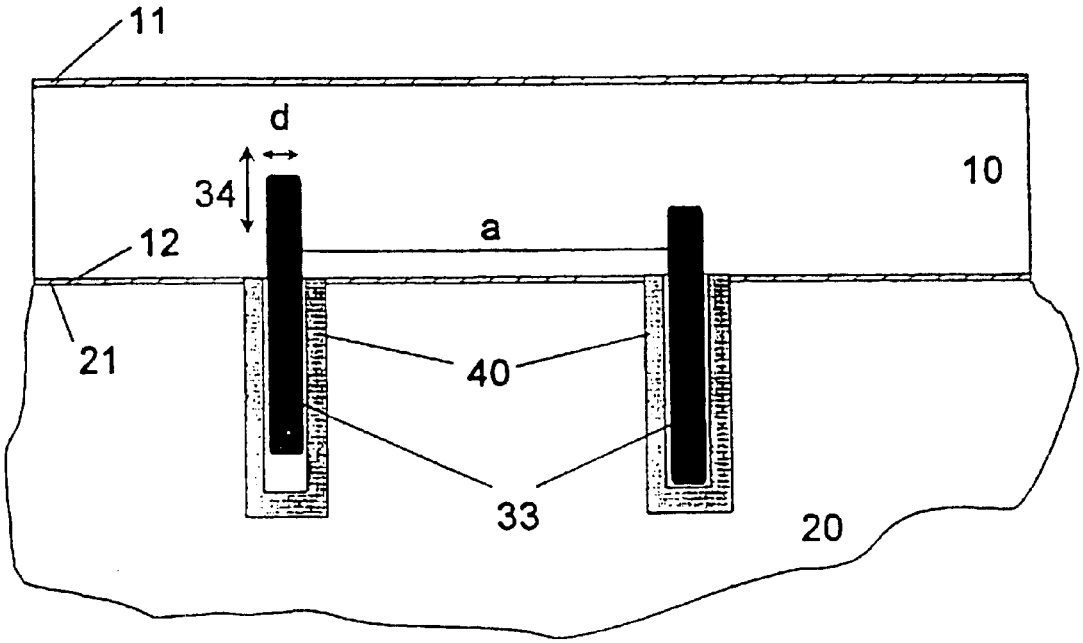

In a further embodiment according to FIG. 2, the coupling pin 33 is shiftable in the direction of the double-headed arrow 34 in a sleeve 40 of a dielectric. The sleeve 40 projects exclusively into the resonator chamber of the applicator.

Figure 3:
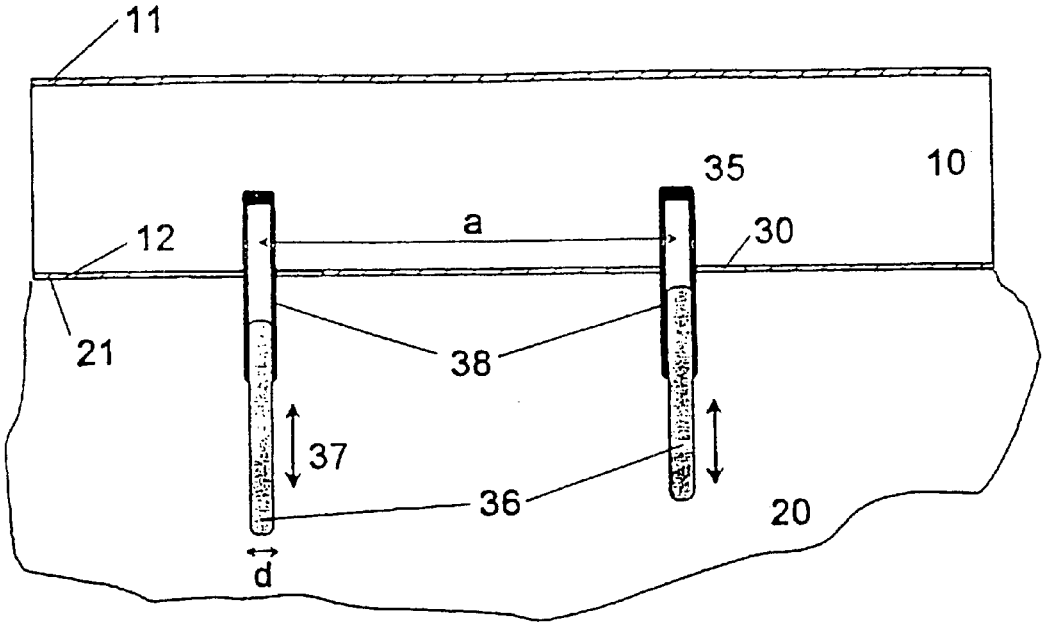

FIG. 3 shows a further variant in which the coupling pin 35 is comprised of a coupling rod 36 which is shiftable longitudinally and axially in a sleeve 38 surrounding it in the direction of the double-headed arrow 37, the sleeve 38 being of electrically conductive material.

Figure 4:
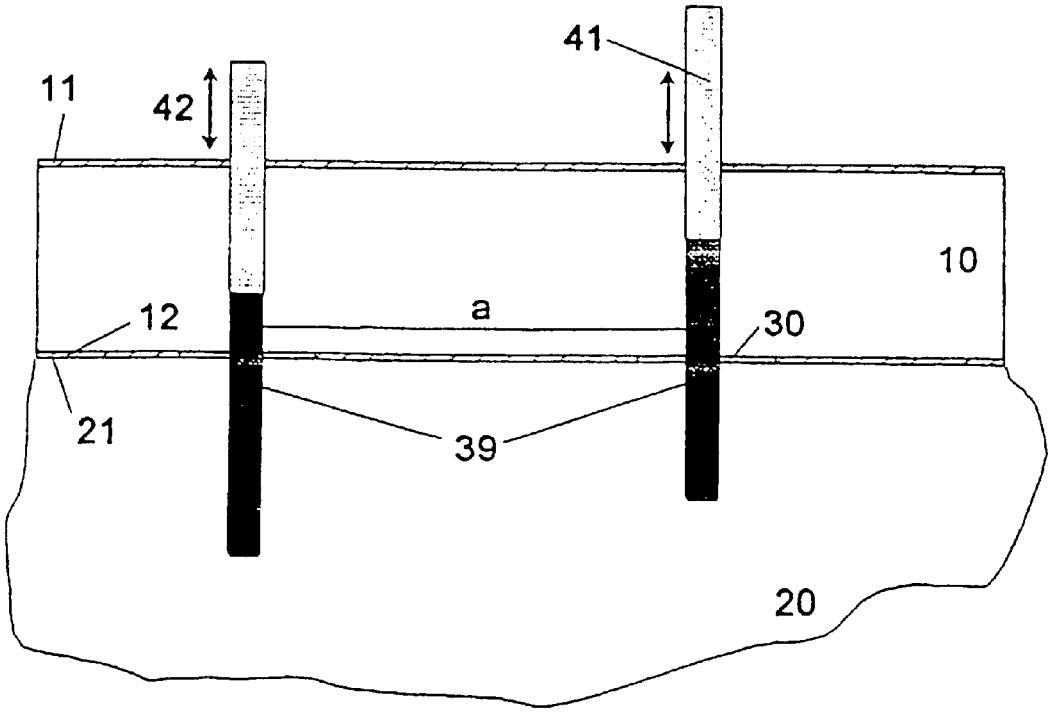

In a last variant according to FIG. 4, the coupling pin 39 is provided with an extension 41 of a dielectric material at its end projecting into the waveguide 10. The rod formed by a combination of parts 39 and 41 is longitudinally axially shiftable along the double-headed arrow 43. As electrically conductive coupling pins 31, 33, 36 and 39, graphite rods with a diameter d of 3 mm at a spacing a of 10 mm are used. By shifting the coupling pins forming the respective antennas, not only can the microwaves from the waveguide be transferred to the applicator interior 20 but a homogeneous field distribution in the interior chamber 20 can be produced by the orientation of the coupling pins.

Figure 5:
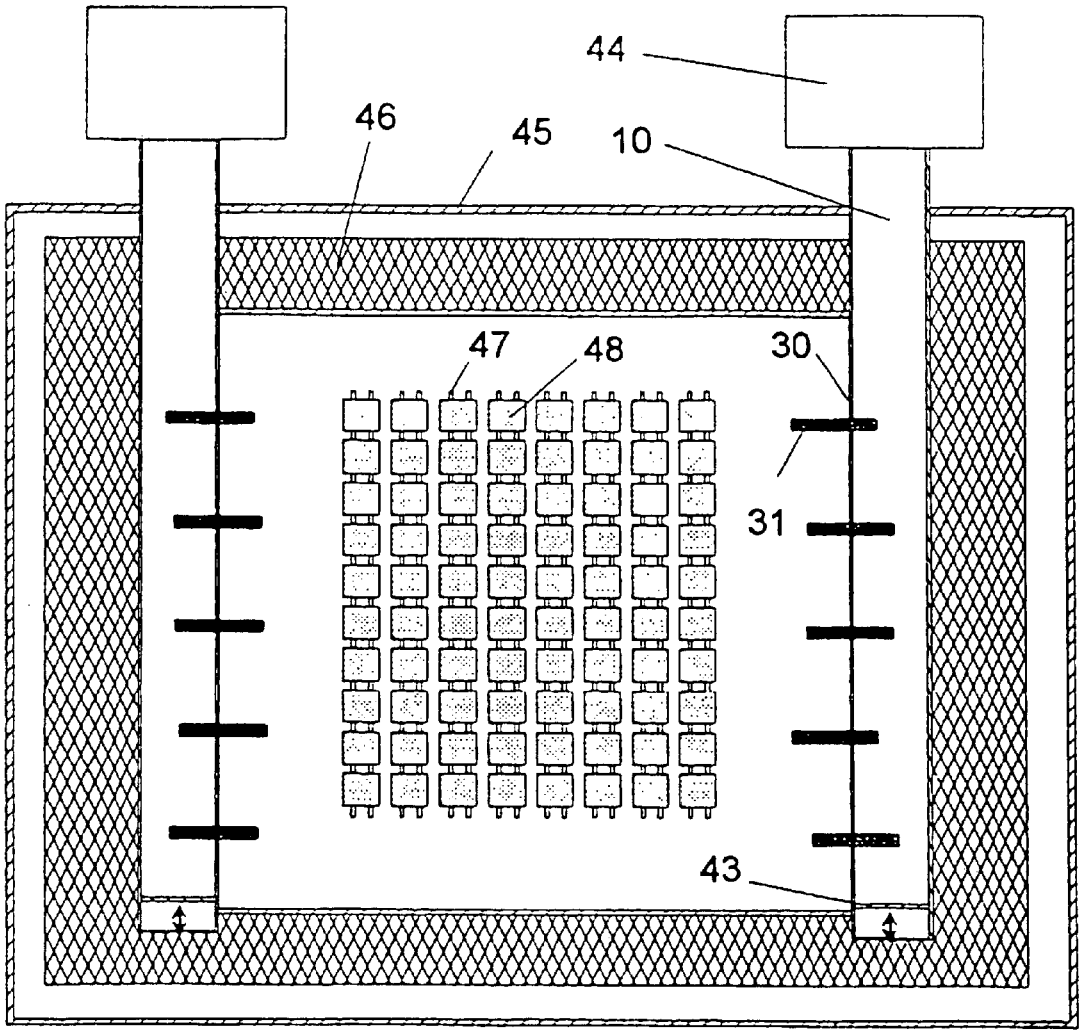
FIG. 5 is a schematic end view of a furnace according to the invention.

FIG. 5 shows a schematic end view of the construction of the device according to the invention whose significant parts are a short-circuiting slider 49, a microwave generator 44, a waveguide 10 which is passed through an opening in the furnace wall 45 and has the already described arrangement of the coupling pins 31. The interior of the oven, in which the hard metal parts 48 are arranged on grates, is shielded from the exterior by a thermal insulation 46.

What is claimed:

1. A device for adjusting a microwave energy density distribution in a resonating chamber in the form of an industrial oven for the heating of green sintered articles, in which the radiation generated by the microwave generators is fed to the oven wall via a waveguide and comprising a plurality of electrically-conductive coupling pins spaced apart in the waveguide and projecting both into a common waveguide chamber as well as into a common resonating chamber of the oven.

2. A device according to claim 1 wherein the coupling pins are shiftable along respective longitudinal axes.

3. A device according to claim 1 wherein the waveguide and a coupling surface of the resonating chamber are arranged with longitudinal axes parallel to one another.

4. A device according to claim 1 wherein a dielectric is arranged around passthroughs through said wall for the coupling pins.

5. A device according to claim 1 wherein the coupling pins are shiftably guided in respective sleeves of dielectric material passing through a wall of the waveguide and the oven.

6. A device according to claim 1 wherein the electrically conductive coupling pins are each formed from a coupling rod and a sleeve surrounding the respective coupling rod in which the coupling rod is longitudinally axially shiftable.

7. A device according to claim 1 each coupling pin at an end projecting into the waveguide has a pin-extending piece of a dielectric which extends through the waveguide along a waveguide diameter and at an opposite end passes outwardly through an opening in the waveguide (8).

8. A device according to claim 1 wherein each coupling pin is composed of graphite, a metal selected from the group consisting of copper, aluminum, tungsten and molybdenum, a metal alloy selected from the group consisting of brass and steel, or an insulator with an electric coating of TiN, and the dielectric is comprised of boron nitride or ceramic selected from the group consisting of aluminum oxide, silicon nitride or quartz.

9. A device according to claim 1 wherein the coupling pins are each arranged in regions of maxima of microwave radiation in the waveguide.

10. A device according to claim 1 wherein there is a capacitative or inductive coupling of the microwave radiation through the coupling pins.

11. A device according to claim 1 wherein the coupling pins are of generally cylindrical configuration with rounded edges and corners.

12. A device according to claim 11 wherein the pins have a diameter (d) of 1 mm to 30 mm and a lengths (1) with which the coupling pins project into the resonator chamber of $1=x\cdot\lambda$ with $0\leqq x\leqq 1$ and $\lambda$=the wavelength of a microwave in the waveguide.

13. A device according to one of claim 1 wherein the waveguide has a dielectric with a diameter matched to a wave resonance.

14. A device according to claim 1 wherein the coupling pins have a spacing (a) of $\lambda/4$ to $\lambda/2$ with $\lambda$=wavelength of a microwave in the waveguide.

15. A device according to claim 1 wherein a grate with rounded grate bars is provided in the resonance chamber for articles to be treated and the grate bars are perpendicular to an electric field of a microwave coupled from the waveguide.

16. A device according to claim 1 wherein neighboring walls of the waveguide and the oven are thermally insulated from one another.

17. The use of the device according to claim 1 for removing binder from green bodies composed of a binder and one of the following materials or for sintering one of these materials, namely, hard metals, cermets, powder metallurgically produced steels or metallic or ceramic magnetic materials including ferrites.

* * * * *